US008965025B2

(12) United States Patent
Shen

(10) Patent No.: US 8,965,025 B2
(45) Date of Patent: Feb. 24, 2015

(54) MICRO-SPEAKER BOX

(71) Applicant: Tao Shen, Shenzhen (CN)

(72) Inventor: Tao Shen, Shenzhen (CN)

(73) Assignees: AAC Acoustic Technologies (Shenzhen) Co., Ltd., Shenzhen (CN); AAC Microtech (Changzhou) Co., Ltd., Changzhou (CN)

( * ) Notice: Subject to any disclaimer, the term of this patent is extended or adjusted under 35 U.S.C. 154(b) by 0 days.

(21) Appl. No.: 13/893,571

(22) Filed: May 14, 2013

(65) Prior Publication Data

US 2013/0308812 A1 Nov. 21, 2013

(30) Foreign Application Priority Data

May 17, 2012 (CN) ..... 2012 2 0224110 U
May 17, 2012 (CN) ..... 2012 2 0224253 U

(51) Int. Cl.
*H04R 1/20* (2006.01)
*H04R 1/28* (2006.01)

(52) U.S. Cl.
CPC ..... *H04R 1/288* (2013.01)
USPC ..... 381/346; 381/345

(58) Field of Classification Search
USPC ..... 381/345–346, 353–354
See application file for complete search history.

(56) References Cited

U.S. PATENT DOCUMENTS

| | | | | |
|---|---|---|---|---|
| 6,932,187 | B2 * | 8/2005 | Banter et al. | 181/149 |
| 7,912,239 | B2 * | 3/2011 | Nishimura et al. | 381/396 |
| 8,155,355 | B2 * | 4/2012 | Ogura et al. | 381/174 |
| 2009/0028370 | A1 * | 1/2009 | Matsumura et al. | 381/386 |

* cited by examiner

*Primary Examiner* — Ahmad F Matar
*Assistant Examiner* — Norman Yu
(74) *Attorney, Agent, or Firm* — Anova Law Group, PLLC

(57) ABSTRACT

A micro-speaker box includes a cabinet with a cavity room, a speaker unit, an amount of adsorbents located in the inside of the cabinet, and a porous layer arranged in the cavity room and dividing the cavity room of the cabinet into two parts, one part for accommodating the speaker unit, the other part filled with the adsorbents. The porous layer defines an acoustical airflow resistance no more than 150 MKS Rayls, and includes billions of stomas. The stomas in the porous layer have diameters in the range of 1 um to 500 um.

5 Claims, 1 Drawing Sheet

MICRO-SPEAKER BOX

FIELD OF THE INVENTION

The present disclosure relates to the art of speakers and, particularly to a micro-speaker box provided with adsorbent material for converting electrical signals including audio information to audible sounds.

DESCRIPTION OF RELATED ART

As described in US Pat. Pub. No. 2008-0149418 A1, A speaker system is provided with a speaker unit and a cabinet (enclosure). The speaker unit can be classified as a full range, a tweeter, a midrange, and a woofer depending on a sound reproduction band. As for the cabinet to which the speaker unit is attached, a rear open type and a closed type are known, and the type is selected depending on its manner of use.

The foregoing speaker cabinet basically uses a baffle plate (front surface plate) having a unit mounting port to which the speaker cabinet is attached and has top, bottom, left and right plate-shaped portions, which are bent behind the mounting plate. Thus, a standing wave is generated inside the cabinet when the speaker unit is driven. Hence, there is a difficulty that a sharp peak/dip is increased in the reproduction frequency.

For this reason, in above-described kind of speaker cabinet, typically, a sound absorbing material is arranged therein, in order to suppress generation of the standing wave.

As the sound absorbing material, glass wool, rock wool, coarse hair wool, coarse hair felt, acetate cotton, or flexible porous curl rock produced from a plastic bottle may be used. However, none of the above materials are cheap because many steps are required in their manufactured, and disposal of such materials is not easy. Also, there is a case in which the attenuation effect of a sound wave does not meet expectations. Some little sound waves input into the cabinet may leak outside of the cabinet, and the leaked wave(s) interferes with the sound wave emitted from the front of the unit. In such a case the lively feeling of the reproduction sound is lost and the reproduced sound quality is deteriorated.

In addition, as the sound absorbing material, a rigid resin short tube made of polypropylene and the like can be used. A bag is filled with the rigid resin short tubes and is used as a pillow. A known speaker unit is packed with and surrounded by the pillow (for example, refer to Japanese Unexamined Patent Application Laid-Open No. 2002-281579).

However, the sound absorbing material made of the rigid resin short tube is not cheap, and a high processing cost is required for the disposal process.

Further, the speaker unit is accommodated inside the sound absorbing material. Thus, not only the sound wave, but also most high band sounds transmitted to a listener, is attenuated. Also, the sound absorbing material resonates with the sound wave of the particular frequency emitted from the front of the unit. Then, such a resonance is propagated as noise to the listener. Hence, high quality sound reproduction cannot be obtained.

Therefore, it is desirable to provide an improved speaker which can overcome the above-mentioned problems.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EMBODIMENT

A micro-speaker box in accordance with an exemplary embodiment of the present invention is used for converting audio electrical signals to audible sounds. The micro-speaker box includes a cabinet, and a speaker unit attached to the cabinet. The speaker unit has a magnetic circuit, at least a vibrating unit corresponding to the magnetic circuit, at least a pair of welding pads for electrically connecting with the vibrating unit for conducting electrical signals to the vibrating units.

Figure 1:
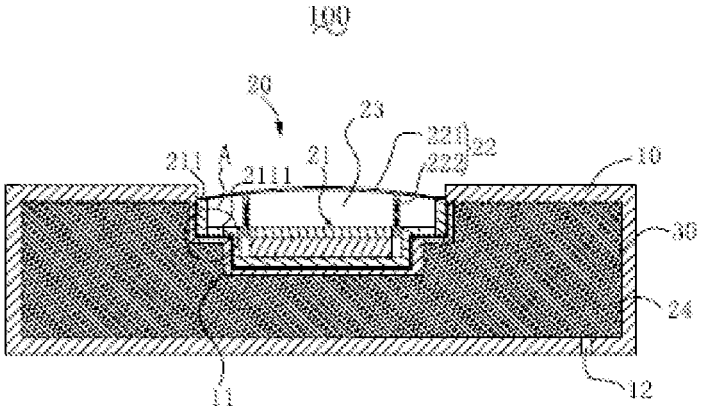
FIG. 1 is a schematic cross-sectional view of a micro-speaker box in accordance with an exemplary embodiment of the present invention.
Figure 2:
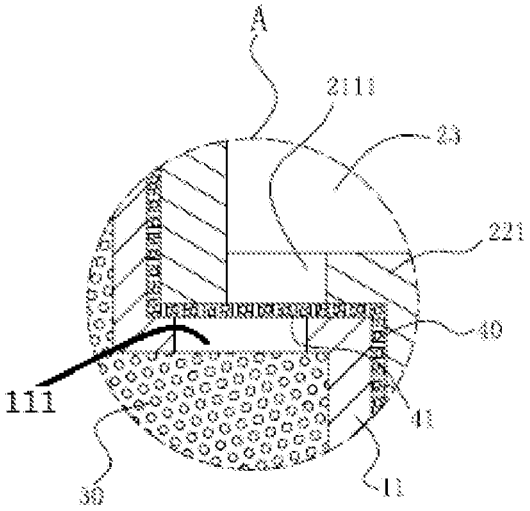
FIG. 2 is an enlarged view of part A in FIG. 1.

Referring to FIGS. 1 and 2, a micro-speaker box 100, in accordance with an exemplary embodiment of the present disclosure, includes a cabinet 10 with a cavity room, a speaker unit 20 attached to the cabinet 10, and an adsorbent 30 located in the inside of the cabinet 10.

The speaker unit 20 defines a magnetic circuit unit 21, and a vibrating unit 22 corresponding to the magnetic circuit unit 21. In the present embodiment, the magnetic circuit unit 21 has a yoke 211 mounted on the cabinet 10, a magnet, a hollow space formed by the yoke 211 for accommodating the magnet and the vibrating unit 13 therein. The vibrating unit 22 comprises a diaphragm 221 supported by the yoke 211, and a voice coil 222 connected directly or indirectly with the diaphragm 221 and actuated by the magnetic field of the magnetic circuit unit 21. The yoke 211 further has a first hole 2111 for balancing an internal acoustic pressure of the speaker unit 20.

The adsorbent 30 may be, for example, a form of activated carbon. Suitable forms of activated carbon include, but are not limited to, powdered activated carbon, granular activated carbon, and fibrous activated carbon. Alternatively, the adsorbent 30 may comprise another type of adsorbent material, for example, silica gel or a zeolite. Alternatively, the adsorbent may comprise a combination of any of the above-mentioned, or any other, adsorbent materials.

In addition, the micro-speaker box 100 further includes a porous layer 40 dividing the cavity room of the cabinet into two parts 23, 24. One part 23 for accommodating the speaker unit 20, the other part 24 is filled with the adsorbent 30. In other words, the porous layer 40 is positioned in the cavity room for wrapping the speaker unit 20 and fully covers the first hole 2111. A first cavity is accordingly formed by the porous layer 40 cooperatively with the cabinet 10 for containing the adsorbent 30. An acoustical airflow resistance of the porous layer 40 is no more than 150 MKS Rayls. The porous layer 40 defines billions of stomas 41. Diameter of each stoma 41 is ten thousand times smaller than that of the adsorbent 30 and is hundred times greater than that of gas molecule. Therefore, gas, such as air, can easily go through the porous layer 40 and, however, the adsorbent 30 can not pass the porous layer 40. Specifically, the diameter of the stomas 41 may be in the range of 1 urn to 500 um. Specifically, the diameter of the stomas 41 may be in the range of 11 um to 39 um, or 41 um to 49 um, or 51 um to 99 um, or 101 um to 199 um, or 201 um to 500 um.

The porous layer 40 may comprise woven fabric, such as a fine polyester mesh. A woven fabric may allow the stomas size to be precisely selected and controlled. Alternatively, if unwoven porous material is used as the porous layer 40, the porous layer 40 may be made from hydrophobic. Thus, the porous layer 40 may repel water. The treatment to the porous layer 40 may be carried out in any suitable manners.

In the embodiment, the cabinet 10 defines a panel 11 arranged in the cavity room. The speaker unit 20 may be fixed on the panel 11 firmly. In addition, the cabinet 10 further includes a second hole 12 for balancing an internal air pressure of the other part 24.

While an electric signal applied, a driving force will be generated in the voice coil 222. With the driving force, the diaphragm 221 of the speaker unit 20 vibrates, thereby generating a sound pressure. And with the sound pressure generated from the diaphragm, a pressure formed in the inside of the cabinet 10 changes. Due to physical characteristic of the porous layer 40, the adsorbent 30 can not pass the porous layer 40. Since the adsorbent 30 are separated from the speaker unit 20 by the porous layer 40, the adsorbent 30 are not scattered, and the arrangement thereof in the cabinet 10 can be easily performed. Thus, the manufacturing process can be greatly improved. In particular, the sound absorbing structure in which the adsorbent 30 is provided in the cabinet 10 can always be properly provided inside various shaped cabinets, depending on various deformations of the cabinet. Also, the adsorbent 30 in cabinet 10 behind the porous payer 40 have a high sound absorption effect. When the adsorbent 30 are arranged inside the cabinet 10, the generation of a standing wave can be suppressed, so as to obtain a flat reproduction frequency that does not have sharp peaks and dips and can improve the quality of the reproduced sound. The feeling of live music is extremely improved over the conventional speaker, and the reproduction of high quality, faithful sound reproduction can be achieved.

While the present invention has been described with reference to a specific embodiment, the description of the invention is illustrative and is not to be construed as limiting the invention. Various of modifications to the present invention can be made to the exemplary embodiment by those skilled in the art without departing from the true spirit and scope of the invention as defined by the appended claims.

What is claimed is:

1. A micro-speaker box, comprising:

a cabinet defining a cavity room;

a speaker unit attached to the cabinet, and including a magnetic unit having a yoke, a vibrating unit corresponding to the magnetic circuit unit;

an adsorbent located in the inside of the cabinet;

a porous layer arranged in the cavity room and dividing the cavity room of the cabinet into two parts, one part for accommodating the speaker unit, the other part filled with the adsorbent which includes a second hole;

the speaker unit wrapped by the porous layer for preventing the adsorbent from entering the speaker unit;

the porous layer defining an acoustical airflow resistance no more than 150 MKS Rayls, and including billions of stomas;

the stomas in the porous layer having diameters in the range of 1 um to 500 um;

the yoke having a first hole communicating with the other part of the cavity room through the porous layer;

the cabinet further including a panel arranged in the cavity room for firmly fixing the speaker unit, the panel including a third hole for communicating with the first hole through the porous layer and a second hole, respectively.

2. The micro-speaker box as claimed in claim 1, wherein the stomas in the porous layer have diameters in the range of 11 um to 39 um.

3. The micro-speaker box as claimed in claim 1, wherein the stomas in the porous layer have diameters in the range of 41 um to 49 um.

4. The micro-speaker box as claimed in claim 1, wherein the stomas in the porous layer have diameters in the range of 51 um to 99 um.

5. The micro-speaker box as claimed in claim 1, wherein the stomas in the porous layer have diameters in the range of 201 um to 500 um.

* * * * *